United States Patent [19]

van der Scheer et al.

[11] 4,319,210

[45] Mar. 9, 1982

[54] CURRENT LIMITING SWITCH CAPABLE OF RAPID CIRCUIT BREAKING

[75] Inventors: Derk van der Scheer, Goor; Hendrik A. Bosch, Hengelo, both of Netherlands

[73] Assignee: Hazemeijer B.V., Hengelo, Netherlands

[21] Appl. No.: 150,930

[22] Filed: May 19, 1980

[30] Foreign Application Priority Data

Apr. 21, 1979 [NL] Netherlands ..... 7903987

[51] Int. Cl.[3] ..... H01H 77/10

[52] U.S. Cl. ..... 335/16; 335/38; 335/189

[58] Field of Search ..... 335/16, 147, 195, 23, 335/35, 38, 189

[56] References Cited

U.S. PATENT DOCUMENTS 3,534,305 10/1972 Strobel ..... 335/16

3,663,903 5/1972 Kussy et al. ..... 335/16

FOREIGN PATENT DOCUMENTS 1933576 3/1970 Fed. Rep. of Germany .

1246837 10/1959 France .

1445288 8/1965 France .

*Primary Examiner*—Harold Broome

*Attorney, Agent, or Firm*—Watson, Cole, Grindle & Watson

[57] ABSTRACT

Current limiting switch for rapid circuit breaking, including at least one pair of contacts, one contact being mounted stationary and the other being mounted on a movable arm. The contact arm is rotatable about a fixed point upon surpassing a predetermined current threshold value, by means of an electromagnet energized by the current passing through the switch. The electromagnetic means comprise an electromagnet and a first and a second armature cooperating with the electromagnet, in which the first armature drives the movable contact in the direction of disengagement and the second armature releases a locking device, which blocks the movable contact in the direction of movement until the current threshold is reached.

7 Claims, 3 Drawing Figures

CURRENT LIMITING SWITCH CAPABLE OF RAPID CIRCUIT BREAKING

BACKGROUND OF THE INVENTION

1. Field of the Invention

The invention relates to a current limiting switch capable of rapid circuit breaking, and more particularly to such a switch including at least one pair of mutually cooperating contacts, one contact of the pair being mounted fixedly and the other one thereof being mounted on a contact arm, the contact arm being operable to rotate about a fixed point and upon surpassing a predetermined current threshold value being destined to be disengaged from the fixed contact in a pivoting movement about a fixed point by electromagnetic means energized by the current passing through the switch. The electromagnetic means comprising an electromagnet and a first and a second armature cooperating with the electromagnet, in which the first armature is operable upon being energized to drive the movable contact in the direction of disengagement and the second armature is operable to release a locking device. The locking device being operable to block the movable contact in the direction of movement until the current threshold is reached. The locking device includes a locking arm operable to rotate about a second fixed point and to forestall the movement of the contact arm in the direction of disengagement in its resting position as long as the current threshold is not surpassed and in which the first and the second armature, respectively, cooperate with the contact arm and the locking arm. The free end of the locking arm in the resting position thereof facing a cam on the contact arm in the direction of rotation in which the contact arm is moved upon energization of the electromagnet.

2. Prior Art

A current limiting switch of this type is known from the French Patent Specification No. 1,246,837. This switch is provided with a single electromagnet operable to attract both a contact armature for breaking the circuit and a second armature for disengaging the locking means, the locking means releasing the contact armature upon disengagement of the locking means when the current through the switch surpasses the predetermined current threshold value. Until the moment of release of the contact a sufficient contact force is maintained so that a sharp definition of the threshold value becomes possible while a welding of the current carrying contact is prevented. This known switch presents, however, the drawback that the contact armature will be kept in the closed contact position until released by the locking means. Upon release the contact armature will fly to its current breaking position so that both in the non-released condition of the armature and upon reaching the final circuit breaking position of the armature the pivot determining the rotary movement of the armature will be subject to high inhomogeneous stresses. This may even be amplified in case of serious fault conditions in which magnetic contact blowoff forces or repulsion forces occur between the contacts.

SUMMARY OF THE INVENTION

The object of the invention is now to provide a current limiting switch capable of rapid circuit breaking not showing the aforesaid drawbacks while maintaining the absence of a mutual relation between the contact force and the force for switching in and for disconnecting, respectively.

According to the invention this object is attained by allowing for blow-off or repulsion forces for breaking the circuit while at the same time decreasing the mass of the armature. The inventive current limiting switch is therefore characterized in that the contact arm comprises two mutually hinging parts, the first part carrying the movable contact and the second part being operable to cooperate with the first armature and with the locking arm of the locking device and to rotate about the first fixed point at its end opposite to the hinge. The first part of the contact arm is coupled to the locking arm in such a manner that upon rotation of the first part of the contact arm about the hinge under the influence of electrodynamic repulsion forces the locking of the second part of the contact arm by the locking arm is released, whereby with respect to the locking device the first part of the contact arm becomes free to hinge about the hinge point together with the second part of the contact arm. The first part of the contact arm being rigidly coupled to a third part of the contact arm corotating with the first part of the contact arm about the hinge point, the end of the third part of the contact arm being coupled to the locking arm in such a manner that upon hinging rotation of the first part of the contact arm the end of the locking arm is moved out of its position facing the cam provided on the second part of the contact arm.

This current limiting switch according to the invention is also capable of immediate circuit breaking upon high short circuit currents. Upon high short circuit currents the fixed and movable contacts will be subject to the aforesaid blowoff or repulsion forces under the influence of which the contacts will be forcebly moved away from each other. These electrodynamic blow-off or repulsion forces will generally cause a more rapid contact separation than will be possible by electromagnetic means. Where the movable contact is operable to move independently from the locking device, an immediate contact separation will occur due to the repulsion forces.

During the contact operation the locking device will also be disengaged by the repulsion forces so that a complete breaking of the circuit is established.

Hence this solution fully utilizes the rapid action of the repulsion forces, while at the same time a further acceleration of the contact is attained because the contact participates in two movements at the same time, i.e. a rotary movement about a fixed point of rotation and likewise a rotary movement about the hinge point. Furthermore the coupling between the first part of the contact arm carring the movable contact and the locking device is such that the circuit breaking movement of the first part of the contact arm is independent from the stroke made by the armature of the locking device towards the electromagnet.

The advantage of the current limiting switch according to the invention that the contact distance between the fixed and the movable contact is already large enough to achieve a breaking of the circuit within the range of the repulsion forces before completing the full separation movement about the fixed hinge point is made possible in that the contact separation due to the movement about the hinge point is not limited by the distance that may be covered by the armature of the locking device in the direction towards the electromagnet.

In a further embodiment of the switch according to the invention the locking function of the locking device may furthermore be influenced by a fixed point of the switch.

In this preferred embodiment of the switch according to the invention, the third part of the contact arm extends in the direction of rotation of the other parts of the contact arm when rotating about the first fixed point of rotation and the third part of the contact arm is provided with a sloping surface. The sloping surface cooperating with a ramp mounted on a fixed part of the switch, the this cooperation being such that rotation about the first fixed point of rotation caused by the armature mounted on the second part of the contact arm and the electromagnet forces the first part of the contact arm to rotate likewise about the hinge point in the direction of circuit breaking of the switch, while the third part of the contact arm cooperates at its end with a slide bearing, the slide bearing being coupled to the free end of the locking arm.

In an alternative embodiment, of the switch according to the invention based on the above preferred embodiment the cam on the contact arm may even be deleted where the function of such a cam may be transferred to the fixed part of the switch. In this way the disengagement of the locking device may be brought under a more direct control of repulsion forces.

This preferred alternative embodiment of the switch of the invention is characterized in that the first part of the contact arm is operable to hinge freely with respect to the locking device about the hinge point with the second part of the contact arm. Also, the locking arm is rotatably mounted at a second fixed point located close to the second part of the contact arm. The locking arm is coupled at its free end to a blocking arm operable to rotate about the hinge point and being provided with blocking means facing a stop fixedly mounted on the switch in the resting position of the locking arm. The coupling of the locking arm to the blocking arm being such that upon movement of the second armature cooperating with the locking arm towards the electromagnet, the locking is released. The locking arm at its end cooperates with a slide bearing coupled to a free end of the locking arm and the slide bearing resting against the stop mounted on a fixed part of the switch in the non-energized condition thereof.

In the latter embodiment of the switch according to the invention it may prove to be advantageous to rely not only on the repulsion forces for circuit breaking but to introduce a forced movement to the first part of the contact arm carrying the movable contact when the locking device is disengaged from the fixed stop of the switch upon energization of the electromagnet.

This further preferred embodiment of the invention is characterized in that close to the hinge point the blocking arm is rigidly coupled to a further part of the blocking arm. The further part of the blocking arm being operable upon departure of the locking arm from the resting position thereof to induce a forced hinging movement to the first part of the contact arm about the hinge point towards the circuit breaking position.

In the latter embodiment of the switch according to the invention, the release of the locking device is preferably brought about in that with respect to the locking device, the first part of the contact arm is operable to hinge freely about the hinge point with the second part of the contact arm. The first part of the contact arm is rigidly coupled to a third part of the contact arm, the third part of the contact arm being operable to rotate about the hinge point. The third part of the contact arm operable at its end to cooperate with a part of the locking arm, that part of the locking arm being rigidly coupled to the locking arm close to the second point of rotation so that a rotation of the first part of the contact arm about the hinge point will lead to the rotation of the locking arm about the second point of rotation to release the blocking operation.

In a further embodiment of the switch the free end of the third part of the contact arm cooperates with a stop mounted on a fixed part of the switch in such a manner that a movement of the contact arm consisting of the first and the second parts in the direction of circuit breaking will cause a rotary movement about the hinge point in the direction opposite to the direction of circuit breaking during a period determined by the distance between the end of the third part of the contact arm and the stop.

In another preferred embodiment of the switch according to the invention, the end of the third part of the contact arm rests against a rotatable arm, the rotatable arm at one end thereof being rotatably mounted in a fixed point of rotation fixedly connected to the switch. The third part of the contact arm is operable upon rotation about the hinge point to impart the forced rotation to the rotatable arm about the point of rotation, while the end of the part of the locking arm is coupled to a slight bearing surrounding the rotatable arm.

BRIEF DESCRIPTION OF THE DRAWING

The invention will now be described in detail with respect to the drawing, wherein.

DETAILED DESCRIPTION

Figure 1:
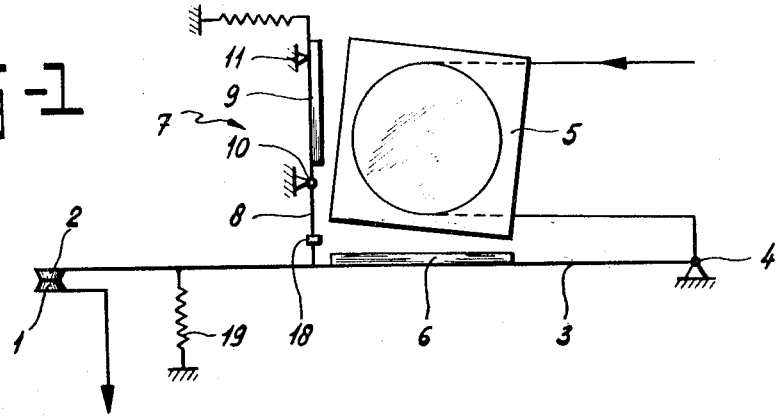
FIG. 1 diagrammatically represents a known current limiting switch capable of rapid circuit breaking as known in principle from FIG. 6 of the French Patent Specification No. 1,246,837 though modified for automatic resetting.

With reference to FIG. 1 there is shown a current limiting switch capable of rapid circuit breaking in the closed position thereof in which the fixed contact 1 is in electrical engagement with the movable contact 2. The movable contact 2 is mounted on a contact arm 3 by means of which the movable contact 2 may be brought in the disengaging or opened position by a rotary movement about a fixed hinge point 4.

The contact arm 3 is driven by an armature 6, mounted on contact arm 3 and the armature cooperating with an only diagrammatically shown electromagnet 5. The energization of this electromagnet 5 is brought about by means of an energizing winding passing the current through the switch.

The electromagnet 5 also cooperates with a locking device 7 comprising a locking arm 8 on which an armature 9 has been mounted. The locking arm 8 is furthermore rotatably mounted about a fixed point of rotation 10, and is kept in the proper position by means of the stop 11. At 18 a locking cam on the contact arm 3 is arrested in its movement by one end of the locking arm 8. A spring 19 provides for the desired contact force and for resetting the switch as well.

When the current through the switch reaches a predetermined value, the armature 6 is attracted by the electromagnet 5, this attraction resulting in a force operable to move armature 6 and consequently also contact arm 3 carrying movable contact 2 towards electromagnet 5. However, this movement is obstructed by the end of the locking arm 8 so that the contact force will still be maintained. By properly dimensioning the electromagnet 5, the armature 9 and the locking device 7 the armature 9 is only moved towards electromagnet 5 upon reaching a predetermined current value, whereby the locking of the contact arm 3 at 18 is released.

Figure 2:
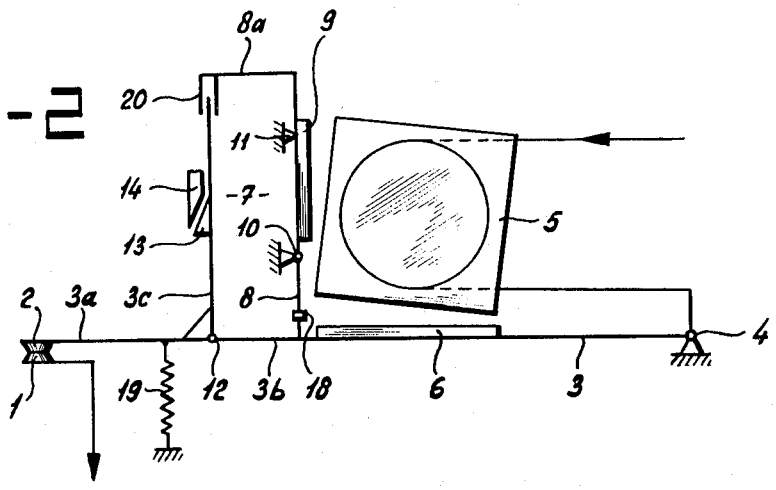
FIG. 2 diagrammatically shows a principle embodiment of the current limiting switch capable of rapid circuit breaking according to the invention.

With reference to FIG. 2 there is shown an embodiment of the current limiting switch according to the invention in which the same parts have been denoted by the same reference numerals as used in FIG. 1. In this embodiment the contact arm 3 comprises two parts; the first part 3*a* of which is hingingly connected to the second part 3*b* at a hinge point 12. The first part 3*a* carrying the movable contact 2, is now operable to rotate independently from the second part 3*b* of the contact arm blocked by the locking device 7 so that upon the occurrence of repulsion forces an unhampered contact separation may take place.

For effecting a release of the locking device in the latter case the first part 3*a* of the contact arm is coupled to the locking device 7. To that effect the first part 3*a* of the contact arm includes a third part 3*c* of the contact arm rigidly connected to first part 3*a* of the contact arm. The third part being operable to corotate hingedly with the first part about the point of rotation 12. The third part 3*c* of the contact arm is coupled to locking arm 8 by means of a slight bearing 20 and a coupling arm 8*a* so that upon the movement about hinge point 12 first part 3*a* of the contact arm also provides for a release of the second part 3*b* of the contact arm at locking cam 18.

Where the second part 3*b* of the contact arm may also be moved towards the electromagnet 5 by means of the armature 6, the hinge point 12 will then be carried along together with first part 3*a* of the contact arm in case of a sufficiently high circuit breaking current, this resulting in an additional acceleration of the already disengaged contact 2.

A further advantage of the coupling between the first part 3*a* of the contact arm and the locking device 7, as shown in FIG. 2, is that in case of a contact separation not caused by repulsion forces, the locking device 7 operates in a complementary manner by means of the armature 9 in driving the movable contact 2 by the armature 6. This also results in a very rapid contact separation.

For effecting a forced rotary movement of the first part 3*a* of the contact arm in the latter case the third part 3*c* of the contact arm may additionally be provided with a part 13 having a sloping surface cooperating with a ramp 14 mounted on a fixed part of the switch. This cooperation being such that upon upward movement of the parts 3*a* and 3*b* of the contact arm, due to the attraction of the armature 6 by the electromagnet 5, the third part 3*c* of the contact arm, and consequently also the first part 3*a* of the contact arm are forced to hinge about the point of rotation 12.

Figure 3:
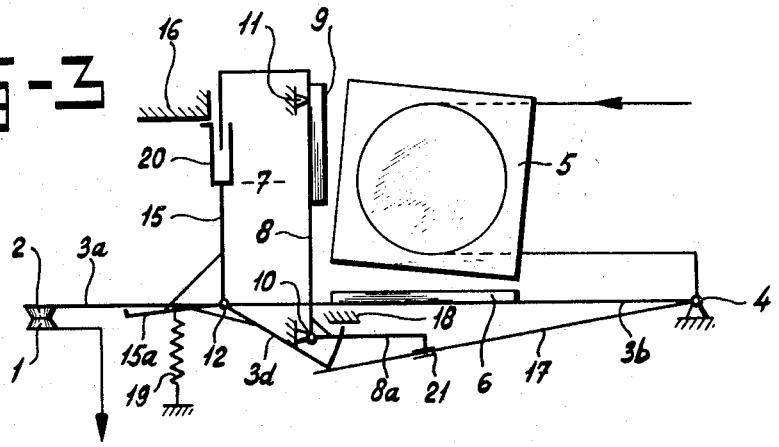
FIG. 3 diagrammatically shows another principle embodiment of the current limiting switch capable of rapid circuit breaking according to the invention.

With reference to FIG. 3 there is shown a special embodiment of the switch according to the invention in which corresponding parts have again denoted by the same reference numerals as in the preceding figures.

The contact arm consists of two hinging parts, parts 3*a* and 3*b* being operable to hinge with respect to each other at 12. The second part 3*b* is provided with the armature 6.

The locking device 7 is of a different embodiment than the one in FIGS. 1 and 2. The first part 3*a* of the contact arm is now operable at the hinge point 12 to hinge also with respect to the blocking arm 15. The modified third part 3*d* of the contact arm is however rigidly coupled to the first part 3*a* of the contact arm so that a co-hinging movement of the parts 3*a* and 3*d* is achieved. The blocking arm 15 is rigidly coupled to the part 15*a* of the blocking arm, the left hand end of which has been bent upward to rest against first part 3*a* of the contact arm. If the blocking arm 15 is now rotated clockwise, the first part 3*a* of the contact arm will be carried along.

At an end portion the third part 3*d* of the contact arm rests against a rotatable arm 17 supported at its right hand end 4 in a freely rotatable manner. The counterclockwise rotation of the parts 3*a* and 3*d* of the contact arm is restricted by a stop 18 mounted fixedly on the switch.

The blocking arm 15 of the locking device 7 terminates in a slide bearing 20 and slidably engages thereby one end of the bent locking arm 8. The slide bearing 20 also rests against the stop 16 fixedly mounted in the switch.

Contrary to the embodiment according to FIG. 2 the arm 8 carrying the armature 9 is now rotatably supported at its lower end 10. At its lower end the arm 8 is also rigidly coupled to the part 8*a* of the locking arm, the right hand end of which surrounds the rotatable arm 17 by means of another slight bearing 21.

The operation of the embodiment of the switch according to FIG. 3 is as follows:

If in case of a fault current condition the armature 6 is attracted by the electromagnet 5 the locking device 7 still provides for maintaining contact force by means of the blocking arm 15 and the stop 16 on the fixed part of the current limiting switch. If now the energization of the electromagnet 5 becomes sufficiently high for attracting the armature 9 then armature 9 and consequently also the locking arm 8 will move towards the electromagnet 5 while carrying the blocking arm 15 along in a rotary movement about the hinge point 12 so that the blocking arm will not be further arrested by the stop 16. Now the second part 3*b* of the contact arm is not blocked anymore and may thus move towards the electromagnet 5. Where the blocking arm 15 and the part 15*a* of the blocking arm are rigidly coupled to each other the first part 3*a* of the contact arm carrying the contact 2 will be forced to corotate about the common hinge point 12 in the direction of circuit breaking, whereby first part 3*a* will corotate with the second part 3*b* of the contact arm about the fixed hinge point 4 until the switch is disengaged.

Upon circuit breaking due to repulsion forces, the contact 2 and consequently also the first part 3*a* of the contact arm will rotate clockwise about the point of rotation 12 in the direction of circuit breaking. Where the first part 3*a* of the contact arm and the third part 3*d* of the contact arm are rigidly connected to each other, third part 3*d* will corotate about the hinge point 12. Upon rotation about the hinge point 12 the end of the third part 3*d* of the contact arm opposite to hinge point 12 will now force the rotatable arm 17 to rotate likewise about the fixed hinge point 4. Due to the coupling between the rotatable arm 17 and the part 8*a* of the locking arm by means of the slide bearing 21 the locking arm 8 starts to rotate about the point 10. Upon rotation about fixed point of rotation 10, the locking arm 8 carries the blocking arm 15 along whereby the locking at stop 16 is released and the switch may be disengaged completely again.

In this embodiment wherein a complete disengagement may be achieved by the unhampered rotation of parts 3*a* and 3*d* of the contact arm including the contact 2 about the point of rotation 12, the rapid action of the repulsion forces is completely utilized.

Moreover in this embodiment the disengagement rate of the contact 2 may yet be accelerated further by a minor modification. To that effect the stop 18 is mounted to the fixed part of the switch in such a manner that stop 18 faces the free end of third part 3*d* of the contact arm. When upon a circuit breaking the contact 2 together with the parts 3*a* and 3*d* of the contact arm try to move about the fixed point of rotation 4, this will lead at first to a counterclockwise rotation of the parts 3*a* and 3*d* of the contact arm about the contact point between the contacts 1 and 2 due to the contact force on the contact 2, exerted, for instance, by a spring 19. This rotation persists until the end of the part 3*d* of the contact arm meets the stop 18. In response thereof the contact 2 will obtain a high acceleration and will then start a clockwise rotation at an increasing rate about the point of rotation 12 while simultaneously participating in the movement about the fixed point of rotation 4.

The invention is not restricted to the embodiments described above and that modifications are possible without departure of the scope of the invention.

The disengagement of the switch may for instance be effected without a disengagement spring, hence solely with the armature 6 or by means of armature 6 in combination with a disengagement spring. In certain applications the armature 6 may even be omitted in which case the disengagement may be achieved by a disengagement spring in combination with the armature 9.

In case an automatic switch is used there may be utilized also solely the armature 6 while a resetting spring automatically resets the switch in the starting position again upon disappearance of the fault.

What is claimed is:

1. A rapid circuit breaking current limiting switch, comprising:

a contact arm operable to rotate about a fixed point;

at least one pair of mutually cooperating contacts, one contact of said pair being mounted fixedly and the other contact of said pair being movably mounted on said contact arm;

electromagnetic means energized by the current passing through the switch and enabling disengagement of said fixed contact from said movable contact with said current exceeding a predetermined threshold, and including a first and second armature, said first armature adapted to move said movable contact in the direction of said disengagement;

a locking device for blocking said movable contact in the direction of movement thereof until said threshold current is reached and being released by said second armature, said locking device including a locking arm operable to rotate about a second fixed point;

said contact arm including a cam confronting the free end of said locking arm in a rest position thereof, a first and second part hingably connected with one another, said first part carrying said movable contact and said second part being adapted to coact with said first armature and said locking arm to rotate about said first fixed point, said first part being coupled to said locking arm such that, upon rotation of said first part, the locking of said second part by said locking arm is released to rotate about said hinge point; and said contact arm further including a third part rigidly coupled to said first part, the free end of said third part being coupled to said locking arm such that such locking arm is moved from the confronting relationship thereof with said cam switch with rotation of said first part.

2. The switch as claimed in claim 1, wherein said third part extends in the direction of rotation of said first and second parts and further including a sloping surface, said switch further comprising a ramp cooperating with said sloping surface such that rotation about said first fixed point forces said first part to similarly rotate about the hinge point in the direction of the circuit-breaking movement of the switch, and said switch further comprising a slide bearing coacting with the end of said third part and being coupled to the free end of said locking arm.

3. The switch as claimed in claim 1, wherein said first part is operable to freely hinge along with said second part with respect to said locking device about said hinge point, and said locking arm being rotatably mounted about a second fixed point located close to said second part, said switch further comprising a blocking arm coupled to the free end of said locking arm and operable to rotate about said hinge point, said switch further comprising a stop member, said blocking arm including a blocking means confronting said stop member, the coupling of said locking arm to said blocking arm in the rest position of the locking arm being such that movement of said second armature releases the locking condition, said switch further comprising a slide bearing cooperating with an end of said blocking arm and being coupled to said free end of said locking arm and resting against said stop member in the non-energized condition of the switch.

4. The switch as claimed in claim 3, wherein said blocking arm further includes another blocking arm portion rigidly coupled to the blocking arm adjacent to said hinge point, said further blocking arm portion being operable upon movement of said locking arm from the rest position thereof to induce a forced hinging movement of said first part about said hinge point towards the circuit breaking position of the switch.

5. The switch as claimed in claim 4, wherein said first part is operable to freely hinge about said hinge point with said second part, said first part being rigidly coupled to said third part, said third part being operable to rotate about said hinge point and the free end thereof coacting with a portion of said locking arm, said locking arm portion being rigidly coupled to said locking arm adjacent to said second point of rotation such that rotation of said first part about said hinge point induces rotation of said locking arm about said second point of rotation to release the blocking condition.

6. The switch as claimed in claim 5, further comprising a second stop member, and wherein said free end of said third part contacts said second stop member such that movement of said first and second parts in the direction of circuit breaking during a period determined by the distance between the free end of said third part and said second stop member induces a rotary movement about said hinge point in a direction opposite to the direction of movement during circuit-breaking operation.

7. The switch as claimed in claim 5, further comprising a rotatable arm mounted to rotate about a third point of rotation, and wherein said free end of said third part rests against said rotatable arm, said third part is operable upon rotation about said hinge point to impart a forced rotation to said rotatable arm about said third point of rotation, and said locking arm portion includes an end coupled to said slide bearing and said slide bearing surrounds said rotatable arm.

* * * * *